US006654678B1

(12) United States Patent
Rodriguez

(10) Patent No.: US 6,654,678 B1
(45) Date of Patent: Nov. 25, 2003

(54) TORQUE-BASED LOW IDLE GOVERNOR

(75) Inventor: Rogelio Rodriguez, Berwyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/385,046

(22) Filed: Mar. 10, 2003

(51) Int. Cl.[7] ..... G60T 7/12

(52) U.S. Cl. ..... 701/104; 123/339.23; 123/352; 701/110

(58) Field of Search ..... 701/101, 102, 701/103, 104, 110; 123/339.19, 339.23, 352, 478, 480, 406.23

(56) References Cited

U.S. PATENT DOCUMENTS 5,268,842 A * 12/1993 Marston et al. ..... 701/105
5,623,906 A * 4/1997 Storhok ..... 123/406.23
5,975,052 A * 11/1999 Moyer ..... 123/406.23
6,260,525 B1 * 7/2001 Moyer ..... 123/90.16
6,584,391 B2 * 6/2003 Lack ..... 701/51

* cited by examiner

*Primary Examiner*—John Kwon
(74) *Attorney, Agent, or Firm*—Dennis Kelly Sullivan; Susan L. Lukasik; Jeffrey P. Calfa

(57) ABSTRACT

An engine control system (10, 12) and method for improving stability of engine running speed when torque subtractions (TTS) from gross torque change while the engine (14) is running at a constant speed, such as at low idle speed. Engine speed error data (Nerror) is processed according to one or more control functions (52, 54, 56) each having gain determined by the torque subtraction data value via function generators (58, 60, 62) to develop fueling adjustment data (P-FGT, I-FGT, D-FGT) for compensating desired engine fueling (MFDES) for the torque subtraction data (TTS).

20 Claims, 2 Drawing Sheets

TORQUE-BASED LOW IDLE GOVERNOR

FIELD OF THE INVENTION

Figure 1A:
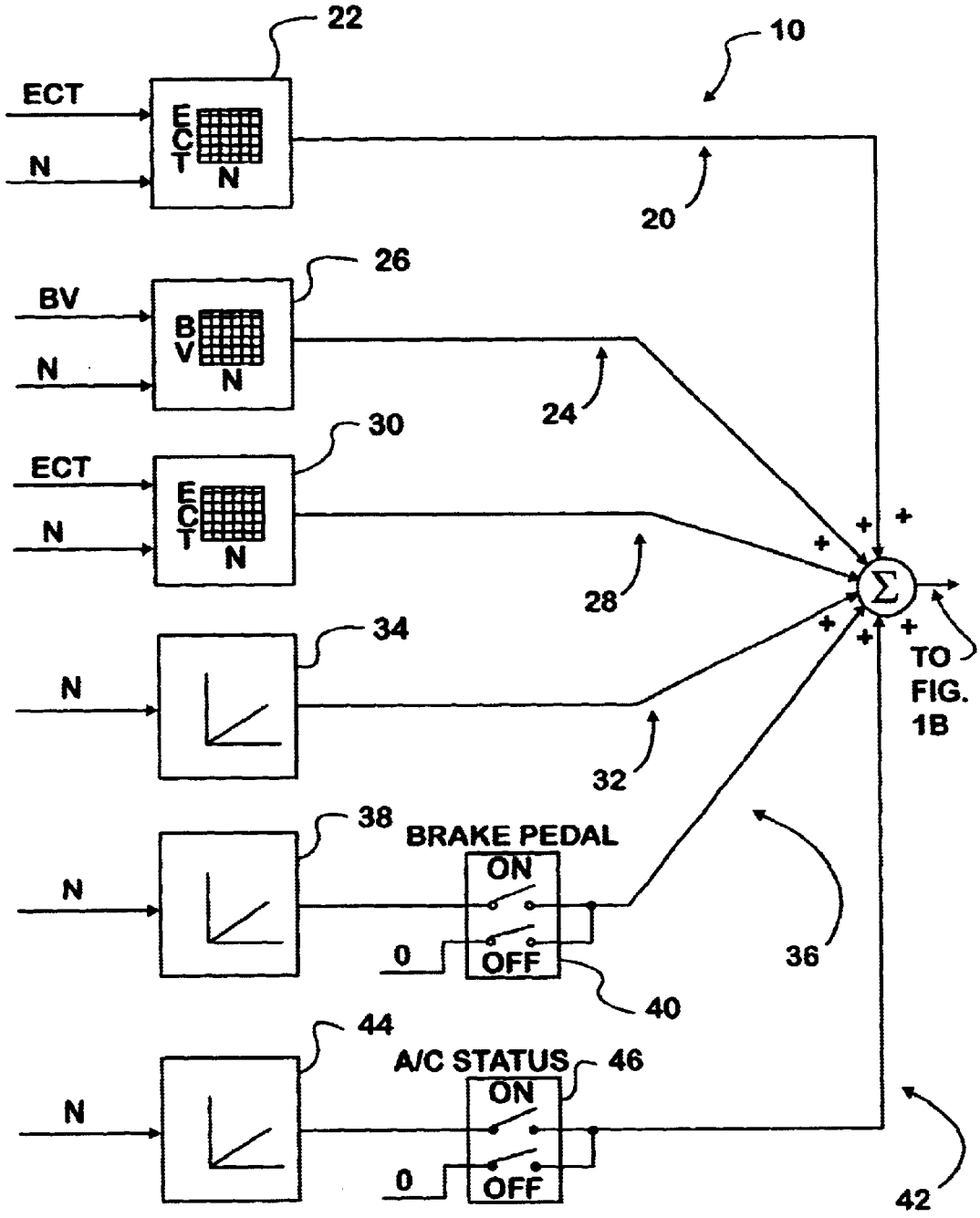

This invention relates generally to internal combustion engines, particularly engines for propelling motor vehicles. More specifically, the invention relates to an engine control system and method for improving stability of engine running speed when torque subtractions from gross torque change while the engine is running at a constant speed, such as at low idle speed.

BACKGROUND OF THE INVENTION

Although a running engine in a motor vehicle develops a gross torque that is based essentially on engine fueling, the net torque that is available at the engine flywheel for delivery to the vehicle drivetrain is less than the gross torque. This is because of certain physical phenomena inherent in the engine as it is running and also certain loads that the engine drives other than the vehicle drivetrain. Consequently, net torque for the drivetrain is equal to gross torque minus total torque that is lost due to such phenomena and other engine loads.

With an engine running at a substantially constant speed such as low idle, a significant change in the total torque subtraction will occasion an incipient engine speed change, with engine speed becoming either higher or lower depending on whether the total torque subtraction increased or decreased. Although resulting disparity between actual engine speed and desired engine speed will be countered by closed-loop control seeking to correct the disparity, the quality of the correction may vary depending on various factors such as the magnitude of the total torque correction change and how fast it is changing. In other words, securing desired stability of engine speed may be difficult or even impossible to achieve in certain circumstances.

Consequently, it is believed that improvements for securing desired stability of engine speed in such circumstances would be beneficial.

SUMMARY OF THE INVENTION

The present invention relates to a system, strategy, and method that provide such improvements in an engine.

One generic aspect of the present invention relates to a method of operating an internal combustion engine that has a fueling system and that delivers net torque to a load. The method comprises: a) developing desired engine fueling data representing desired fueling for the engine; b) developing i) data representing a value of torque subtraction accounting for torque, that if added to net torque, would correspond to gross torque developed by the engine from fueling, ii) data representing speed at which the engine is running, and iii) data representing desired engine running speed. The torque subtraction data and the desired engine speed data are processed to develop feed-forward fueling data representing fueling that is projected to cause the engine to run at desired speed. The data representing speed at which the engine is running and the data representing desired engine running speed are processed to develop data representing engine speed error which is then processed according to one or more control functions each having gain determined by the torque subtraction data value to develop fueling adjustment data for compensating desired engine fueling for the torque subtraction data. The fueling adjustment data and the feed-forward fueling data are processed to develop desired engine fueling data representing desired fueling for the engine, with the engine fueling system fueling the engine in accordance with the desired engine fueling data.

Another generic aspect relates to an engine that operates according to the method just described.

Still other generic aspect relates to an engine control system for performing the method just described.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1B:
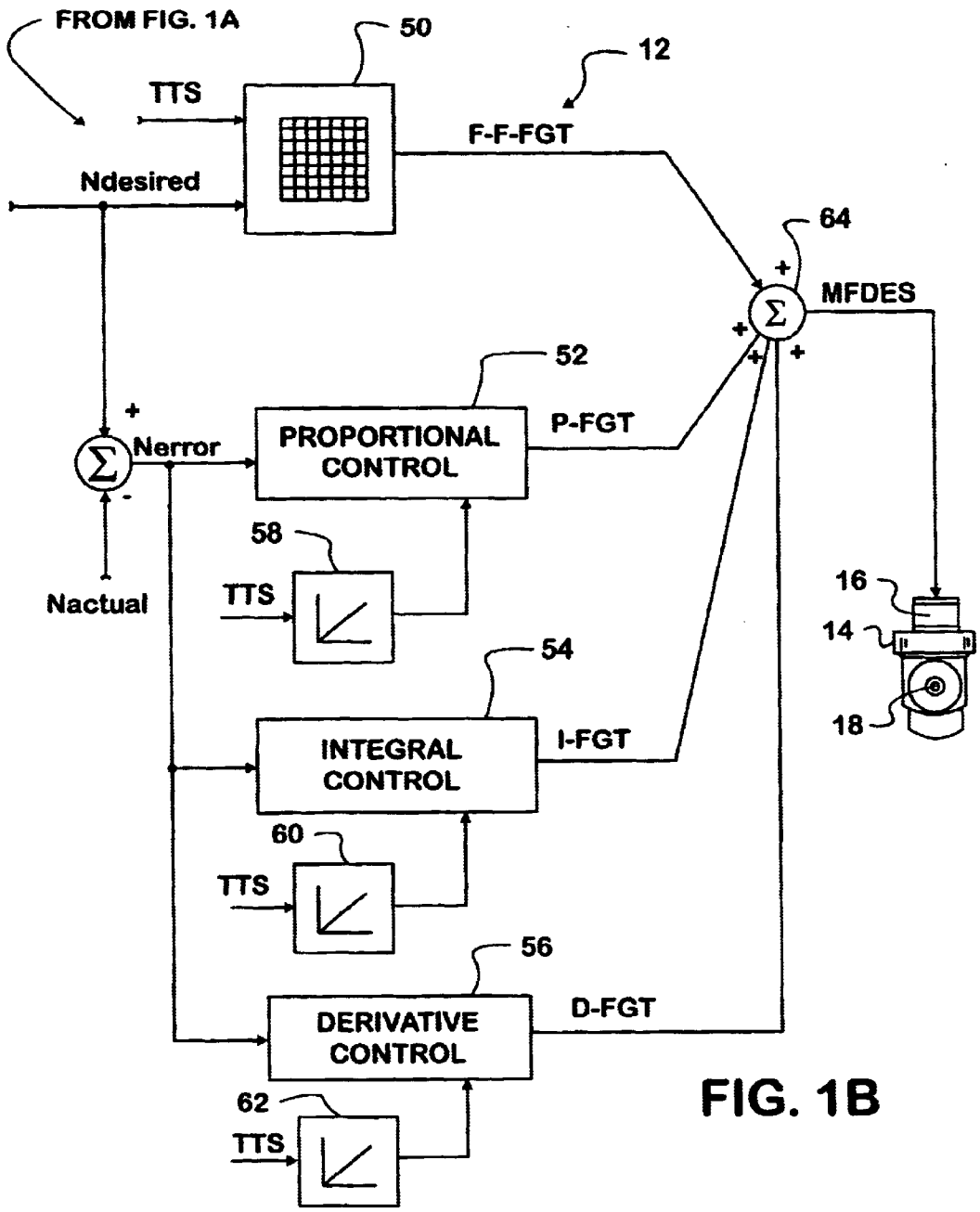

FIG. 1A shows a first portion 10, and FIG. 1B a second portion 12, of the inventive system, strategy and method for controlling fueling of a diesel engine 14 having a fueling system 16 in a way that is believed to have improved effectiveness in stabilizing engine running speed when torque subtractions from gross torque change while the engine is running at low idle speed. An example of fueling system 16 comprises electrically controlled fuel injectors that inject fuel into individual engine cylinders.

Engine 14 comprises an electronic engine control that possesses digital processing capability for processing data from various data sources to develop certain data for control of various functions associated with operation of engine 14. Certain processed data represents variables and may originate at external sources (input variables) and/or be generated internally (local variables). Other data may be programmed into and stored in the electronic engine control. From certain input and programmed data, the electronic engine control develops data for controlling engine fueling. The electronic engine control contains a software program that implements one or more algorithms used for control of engine operation, including control of engine fueling according to the strategy of FIGS. 1A and 1B.

A running engine develops a gross torque that is based on engine fueling. However, net torque that is available at the engine flywheel 18 for delivery to a load, such as the drivetrain in the case of a motor vehicle like a truck, is less than the gross torque. Subtractions from gross torque may be considered to fall under two general categories: 1) those which are inherent due simply to the running of an internal combustion engine; and 2) those due to loads, other than the drivetrain, that are powered by the engine.

Friction, the pumping action of pistons reciprocating within engine cylinders, and the pumping of oil by an internal oil pump are examples of torque subtractions that fall under the first category. Devices such as an air conditioning compressor, a radiator cooling fan, an alternator, a power steering pump, and a hydraulic brake pump are examples that fall under the second category.

Portion 10 illustrates that portion of the strategy for calculating total torque subtraction that is to be subtracted from gross torque in order to calculate net torque for the drivetrain. Net torque is a useful parameter in various aspects of engine control. It should be understood that the particular torque subtractions shown in FIG. 1A are merely exemplary and not necessarily intended to be comprehensive.

The torque subtraction for torque that is lost due to the inherent running of engine 14 (first category subtraction) is accounted for by inherent running torque subtraction section 20 in this example. Torque subtractions due to loads other than the drivetrain (second category subtraction) are made for an engine-driven alternator for the vehicle electrical system, an engine-driven fan for the engine cooling system, an engine-driven power steering pump for the vehicle steering system, an engine-driven hydraulic pump for the vehicle brakes, and an engine-driven compressor for the occupant compartment air conditioning system.

Inherent running torque subtraction section 20 uses engine temperature and engine speed to calculate torque subtraction due to running friction and pumping losses. Engine temperature has an effect on torque subtraction when running friction and pumping losses change with temperature. Engine coolant temperature is used as an indicator of engine temperature, and so engine coolant temperature data ECT forms one input to a map, or look-up table, 22 that correlates each of a number of combinations of values of engine temperature and engine speed with a corresponding torque subtraction value. Engine speed data N forms the other input to look-up table 22.

Alternator torque subtraction section 24 uses battery voltage and engine speed to calculate torque subtraction due to the load of an alternator on the engine. Battery voltage data BV forms one input to a map, or look-up table, 26 that correlates each of a number of combinations of values of battery voltage and engine speed with a corresponding torque subtraction value. Engine speed data N forms the other input to look-up table 26.

Engine cooling fan torque subtraction section 28 uses engine temperature and engine speed to calculate torque subtraction due to the load of a radiator cooling fan on the engine. Engine coolant temperature is used as an indicator of engine temperature, and so engine coolant temperature data ECT forms one input to a map, or look-up table, 30 that correlates each of a number of combinations of values of engine temperature and engine speed with a corresponding torque subtraction value. Engine speed data N forms the other input to look-up table 30.

Power steering pump torque subtraction section 32 uses engine speed to calculate torque subtraction due to operation of a power steering pump by the engine. Engine speed data N forms an input to a function generator 34 that correlates each of a number of values of engine speed with a corresponding torque subtraction value.

Hydraulic brake pump torque subtraction section 36 uses engine speed to calculate torque subtraction due to operation of a power brake pump by the engine. Engine speed data N forms an input to a function generator 38 that correlates each of a number of values of engine speed with a corresponding torque subtraction value. A switch function 40 determines if the torque subtraction value is to be used in the calculation of total torque subtraction. Only when the hydraulic brake pedal is being applied is this particular subtraction introduced into the calculation of total torque subtraction.

Air conditioning compressor torque subtraction section 42 uses engine speed to calculate torque subtraction due to operation of an air conditioning compressor. Engine speed data N forms an input to a function generator 44 that correlates each of a number of values of engine speed with a corresponding torque subtraction value. A switch function 46 determines if the torque subtraction value is to be used in the calculation of total torque subtraction. Only when the air conditioner is "on" is this particular subtraction introduced into the calculation of total torque subtraction.

The individual torque subtraction calculations performed by sections 20, 24, 28, 32, 36, and 42 are summed by a summing function 48 to create total torque subtraction data TTS.

In FIG. 1B, total torque subtraction data TTS forms one input to a map, or look-up table, 50, and desired engine speed data Ndesired forms the other input. Look-up table 50 correlates each of a number of combinations of values of torque subtraction and engine speed with a corresponding value representing a first contribution toward computation of a value representing desired fueling data MFDES. This first contribution provided by look-up table 50 may be considered as one term of a formula, hence the designation "feed-forward fuel governor term", as represented by the value of data designated F-F-FGT. There are three other possible contributions toward computation of a value for desired fueling data MFDES. They are: a "proportional fuel governor term", an "integral fuel governor term", and a "derivative fuel governor term". The proportional fuel governor term, represented by the value of data designated P-FGT is provided by a proportional control function 52, the integral fuel governor term, represented by the value of data designated I-FGT is provided by an integral control function 54, and the derivative fuel governor term, represented by the value of data designated D-FGT is provided by a derivative control function 56.

Collectively, control functions 52, 54, 56 form a P-I-D control for closed loop adjustment of desired fueling data MFDES based on the value of engine speed error data Nerror obtained by subtraction of the value of actual engine speed data N from a value for desired engine speed data Ndesired. When engine 14 is running at low idle speed, the value of Ndesired represents the value of low idle speed.

Each control function 52, 54, 56 has its own gain. In accordance with principles of the invention, the gain of each control function is made a function of the total torque subtraction data TTS. A respective function generator 58, 60, 62 shown in FIG. 1B has total torque subtraction data TTS as an input and contains values representing gain for the respective control function correlated with values of total torque subtraction data. Based on the value of the total torque subtraction data TTS, the respective function generator 58, 60, 62 sets the gain of the respective control function 52, 54, 56. The four data values F-F-FGT, P-FGT, I-FGT, and D-FGT are summed together by a summing function 64 to yield a value for desired engine fueling data MFDES.

The value for desired engine fueling data MFDES establishes the actual fueling of the engine. With the engine running exactly at desired speed Ndesired, the value for feed-forward fuel governor data F-F-FGT should, in theory, become the value for desired engine fueling data MFDES so that the P-I-D control provided by control functions 52, 54, 56 furnishes no contribution to desired engine fueling data MFDES.

In actual practice, a significant change in the total torque subtraction will occasion an incipient engine speed change from a substantially constant speed, such as low idle, at which the engine had been running. Engine speed will become either higher or lower depending on whether the total torque subtraction increased or decreased. The resulting disparity between actual engine speed and desired engine speed is countered by the closed-loop P-I-D control seeking to correct the disparity.

With engine 14 running at low idle speed, the nature of certain changes in total torque subtraction may impede re-attainment of low idle speed and create more noticeable and undesired fluctuations in engine speed as the P-I-D control seeks to restore low idle speed. Principles of the present invention however can prevent or at least minimize such undesired fluctuations. While the invention is useful for low idle speed regulation in a diesel engine, it is believed also useful for "high idle" speed regulation (i.e. isochronous engine speed control.

With the engine running at a substantially constant speed such as low idle, a significant change in the value of total torque subtraction will be effective via look-up table 50 to change the value of feed-forward fuel governor data F-F-FGT, also changing the value of engine fueling data MFDES. The change will either increase or decrease fueling depending on whether the torque subtraction change is positive or negative. The change in fueling will cause engine speed to change, and therefore cause the speed error data value Nerror to also change. The P-I-D control will now act to adjust the fueling in a way that will bring the engine speed back to the desired speed Ndesired.

By using total torque subtraction to set the gain of control functions 52, 54, 56 via function generators 58, 60, 62, the change in total torque subtraction becomes effective to adjust the individual gains of the three control functions in a manner that seeks to minimize the effect of the change in total torque subtraction on engine speed, thereby minimizing fluctuations in engine speed, i.e. improving speed stability, as the engine seeks to hold desired speed. The particular characteristics for function generators 58, 60, 62 in a particular engine are determined by calculation and/or empirically.

While a presently preferred embodiment of the invention has been illistrated and described, it should be appreciated that principles of the invention apply to all embodiments falling within the scope of the following claims.

What is claimed is:

1. A control system for an internal combustion engine that delivers net torque to a load, the control system comprising:

one or more processors for processing various data to develop data for control of various engine functions including control of engine fueling;

an operating program for causing the one or more processors to develop desired engine fueling data representing desired fueling for the engine by a) developing i) data representing a value of torque subtraction accounting for torque, that if added to net torque, would correspond to gross torque developed by the engine from fueling, ii) data representing speed at which the engine is running, and iii) data representing desired engine running speed, b) processing the torque subtraction data and the desired engine speed data to develop feed-forward fueling data representing fueling that is projected to cause the engine to run at desired speed, c) processing the data representing speed at which the engine is running and the data representing desired engine running speed to develop data representing engine speed error;

d) processing the engine speed error data according to one or more control functions each having gain determined by the torque subtraction data value to develop fueling adjustment data for compensating desired engine fueling for the torque subtraction data; and e) processing the fueling adjustment data and the feed-forward fueling data to develop desired engine fueling data representing desired fueling for the engine.

2. A control system as set forth in claim 1 including a look-up table of feed-forward fueling values correlated with combinations of values of torque loss data and desired engine speed data that provides, in accordance with values of the torque subtraction data and the desired engine speed data, the feed-forward fueling data representing fueling that is projected to cause the engine to run at desired speed.

3. A control system as set forth in claim 1 in which the one or more control functions each having gain determined by the torque subtraction data value comprise a proportional control.

4. A control system as set forth in claim 3 including a function generator containing values representing gain for the proportional control correlated with values of total torque subtraction data for determining a value of gain for the proportional control in accordance with the torque subtraction data value.

5. A control system as set forth in claim 1 in which the one or more control functions each having gain determined by the torque subtraction data value comprise an integral control.

6. A control system as set forth in claim 5 including a function generator containing values representing gain for the integral control correlated with values of total torque subtraction data for determining a value of gain for the integral control in accordance with the torque subtraction data value.

7. A control system as set forth in claim 1 in which the one or more control functions each having gain determined by the torque subtraction data value comprise a derivative control.

8. A control system as set forth in claim 7 including a function generator containing values representing gain for the derivative control correlated with values of total torque subtraction data for determining a value of gain for the derivative control in accordance with the torque subtraction data value.

9. A control system as set forth in claim 1 in which the one or more control functions each having gain determined by the torque subtraction data value comprise a proportional control, an integral control, and a derivative control.

10. A control system as set forth in claim 9 including a look-up table of feed-forward fueling values correlated with combinations of values of torque loss data and desired engine speed data for providing, in accordance with values of the torque subtraction data and the desired engine speed data, the feed-forward fueling data representing fueling that is projected to cause the engine to run at desired speed.

11. An internal combustion engine for delivering net torque to a load and comprising:

a fueling system for fueling the engine;

one or more processors for processing various data to develop data for control of various engine functions including control of engine fueling;

an operating program for causing the one or more processors to develop desired engine fueling data representing desired fueling for the engine by a) developing i) data representing a value of torque subtraction accounting for torque, that if added to net torque, would correspond to gross torque developed by the engine from fueling, ii) data representing speed at which the engine is running, and iii) data representing desired engine running speed, b) processing the torque subtraction data and the desired engine speed data to develop feed-forward fueling data representing fueling that is projected to cause the engine to run at desired speed, c) processing the data representing speed at which the engine is running and the data representing desired engine running speed to develop data representing engine speed error, d) processing the engine speed error data according to one or more control functions each having gain determined by the torque subtraction data value to develop fueling adjustment data for compensating desired engine fueling for the torque subtraction data, e) processing the fueling adjustment data and the feed-forward fueling data to develop desired engine fueling data representing desired fueling for the engine, and f) causing the engine fueling system to fuel the engine in accordance with the desired engine fueling data.

12. An engine as set forth in claim 11 including a look-up table of feed-forward fueling values correlated with combinations of values of torque loss data and desired engine speed data that provides, in accordance with values of the torque subtraction data and the desired engine speed data, the feed-forward fueling data representing fueling that is projected to cause the engine to run at desired speed.

13. An engine as set forth in claim 11 in which the one or more control functions each having gain determined by the torque subtraction data value comprise a proportional control, an integral control, and a derivative control.

14. A control system as set forth in claim 13 including a look-up table of feed-forward fueling values correlated with combinations of values of torque loss data and desired engine speed data for providing, in accordance with values of the torque subtraction data and the desired engine speed data, the feed-forward fueling data representing fueling that is projected to cause the engine to run at desired speed.

15. An engine as set forth in claim 13 including, for each of the proportional, integral, and derivative control functions, a respective function generator containing values representing gain for the respective control function correlated with values of total torque subtraction data for determining a value of gain for the respective control function in accordance with the torque subtraction data value.

16. A method of operating an internal combustion engine that has a fueling system and that delivers net torque to a load, the method comprising:

a) developing desired engine fueling data representing desired fueling for the engine;

b) developing i) data representing a value of torque subtraction accounting for torque, that if added to net torque, would correspond to gross torque developed by the engine from fueling, ii) data representing speed at which the engine is running, and iii) data representing desired engine running speed;

c) processing the torque subtraction data and the desired engine speed data to develop feed-forward fueling data representing fueling that is projected to cause the engine to run at desired speed;

d) processing the data representing speed at which the engine is running and the data representing desired engine running speed to develop data representing engine speed error;

e) processing the engine speed error data according to one or more control functions each having gain determined by the torque subtraction data value to develop fueling adjustment data for compensating desired engine fueling for the torque subtraction data;

f) processing the fueling adjustment data and the feed-forward fueling data to develop desired engine fueling data representing desired fueling for the engine; and g) causing the engine fueling system to fuel the engine in accordance with the desired engine fueling data.

17. A method as set forth in claim 16 in which the step of processing the torque subtraction data and the desired engine speed data to develop feed-forward fueling data representing fueling that is projected to cause the engine to run at desired speed comprises obtaining the feed-forward fueling data representing fueling that is projected to cause the engine to run at desired speed from a look-up table of feed-forward fueling values correlated with combinations of values of torque loss data and desired engine speed data.

18. A method as set forth in claim 16 in which the step of processing the engine speed error data according to one or more control functions each having gain determined by the torque subtraction data value to develop fueling adjustment data for compensating desired engine fueling for the torque subtraction data comprises processing the engine speed error data according to proportional, integral, and derivative control functions each having gain determined by the torque subtraction data value.

19. A method for low idle speed control of an internal combustion engine that has a fueling system and that delivers net torque to a load, the method comprising:

a) developing desired engine fueling data representing desired fueling for the engine at low idle;

b) developing i) data representing a value of torque subtraction accounting for torque, that if added to net torque, would correspond to gross torque developed by the engine from fueling, ii) data representing speed at which the engine is running, and iii) data representing low idle speed;

c) processing the torque subtraction data and the low idle speed data to develop feed-forward fueling data representing fueling that is projected to cause the engine to run at low idle speed;

d) processing the data representing speed at which the engine is running and the data representing low idle speed to develop data representing engine speed error;

e) processing the engine speed error data according to one or more control functions each having gain determined by the torque subtraction data value to develop fueling adjustment data for compensating desired engine fueling for the torque subtraction data;

f) processing the fueling adjustment data and the feed-forward fueling data to develop desired engine fueling data representing desired fueling for the engine; and g) causing the engine fueling system to fuel the engine in accordance with the desired engine fueling data.

20. A method as set forth in claim 19 in which the step of processing the engine speed error data according to one or more control functions each having gain determined by the torque subtraction data value to develop fueling adjustment data for compensating desired engine fueling for the torque subtraction data comprises processing the engine speed error data according to proportional, integral, and derivative control functions each having gain determined by the torque subtraction data value.

* * * * *